US012480510B2

(12) United States Patent
Whitaker

(10) Patent No.: US 12,480,510 B2
(45) Date of Patent: Nov. 25, 2025

(54) PoE COOLING FAN

(71) Applicant: Origin Acoustics, LLC, Las Vegas, NV (US)

(72) Inventor: Joseph Whitaker, Las Vegas, NV (US)

(73) Assignee: Origin Acoustics, LLC, Las Vegas, NV (US)

( * ) Notice: Subject to any disclaimer, the term of this patent is extended or adjusted under 35 U.S.C. 154(b) by 43 days.

(21) Appl. No.: 18/600,749

(22) Filed: Mar. 10, 2024

(65) Prior Publication Data

US 2024/0301886 A1 Sep. 12, 2024

Related U.S. Application Data

(60) Provisional application No. 63/451,502, filed on Mar. 10, 2023.

(51) Int. Cl.

| | |
|---|---|
| ***F04D 27/00*** | (2006.01) |
| ***F04D 25/06*** | (2006.01) |
| *F04D 25/16* | (2006.01) |

(52) U.S. Cl.

CPC ..... *F04D 27/004* (2013.01); *F04D 25/0673* (2013.01); *F04D 25/0693* (2013.01); *F04D 27/001* (2013.01); *F04D 25/166* (2013.01)

(58) Field of Classification Search

CPC ..... F04D 27/004; F04D 25/0673; F04D 25/0693; F04D 27/001; F04D 25/166

See application file for complete search history.

(56) References Cited

U.S. PATENT DOCUMENTS

| | | | | |
|---|---|---|---|---|
| 7,009,510 | B1 * | 3/2006 | Douglass | G08B 25/08 340/520 |
| 11,500,716 | B2 | 11/2022 | Lu | |
| 11,582,879 | B2 | 2/2023 | Jean-Francois et al. | |
| 11,800,693 | B1 * | 10/2023 | Sampath | H05K 7/20736 |
| 2004/0057788 | A1 * | 3/2004 | Gundlach | H05K 7/1489 403/381 |
| 2012/0210169 | A1 * | 8/2012 | Coile | G06F 11/2092 714/22 |
| 2013/0148293 | A1 | 6/2013 | Shih | |
| 2019/0064890 | A1 * | 2/2019 | Donachy | H05K 7/20754 |
| 2019/0346163 | A1 | 11/2019 | Walsh | |
| 2020/0218594 | A1 | 7/2020 | Lu et al. | |
| 2021/0392006 | A1 | 12/2021 | Rathinasamy et al. | |
| 2022/0150080 | A1 | 5/2022 | Cao et al. | |
| 2022/0329447 | A1 | 10/2022 | Wang et al. | |
| 2023/0039961 | A1 * | 2/2023 | Lingle | G01S 5/02585 |

* cited by examiner

*Primary Examiner* — Andrew J Marien

(74) *Attorney, Agent, or Firm* — Kirk A. Buhler; Buhler & Associates Patenting

(57) ABSTRACT

Improvements in a cooling fan are disclosed where power to the fan is provided by the Ethernet connection. The fan module is connected to the Ethernet such that power to the fan is from a portion of the power to the Ethernet is stolen or otherwise parasitically harvested. Depending upon the available Ethernet power, the fan can be powered directly, or from a storage supply such as a battery. The speed of the fan can also be adjusted based on a local temperature sensor. Measuring a local temperature provides the best indicator for when air movement and air volume is needed. The temperature sensor can be located on a specific device, housing or in the air around the fan. Fan speed and the temperature to be communicated to other devices or a host over the Ethernet or to a cloud-based application or database.

11 Claims, 3 Drawing Sheets

PoE COOLING FAN

CROSS-REFERENCE TO RELATED APPLICATIONS

This application claims the benefit of Provisional Application Ser. No. 63/451,502 filed Mar. 10, 2023, the entire contents of which is hereby expressly incorporated by reference herein.

PRIOR ART

U.S. Pat. No. 11,582,879 issued on Feb. 14, 2023, to Jean-Francois Vincent et al., and is titled Fan-Less Mode in a power Over Ethernet (POE) Network Device. This patent discloses techniques for implementing a fan-less mode in a Power over Ethernet (POE) network device are provided. According to one set of embodiments, the PoE network device can receive a user command to enable the fan-less mode. In response to the command, the PoE network device can (1) turn off the active cooling fans of the device, and (2) modify a PoE power budget of the device from a first amount to a second, reduced amount that is less than the first amount. While the patent discloses the ability to control a fan, the control for the fan is from the Ethernet communication to the fan for control.

U.S. Publication 20130148293 was published on Jun. 13, 2013, to Chih-Chung Shih and is titled Server System with Fan Speed Control. This publication discloses a server system includes a server cabinet, a network switch, a number of servers accommodated in the server cabinet, a number of fan groups, and a number of fan control boards connected to the network switch via Ethernet connections. The fan groups are coupled to a rear side of the server cabinet and each comprising a number of parallel fans to provide a horizontal airflow to cool several of the servers. Each of the fan control boards is connected to one of the fan groups and configured to convert a data packet to an electrical signal for controlling a rotation speed of the corresponding one of the fan groups. Fan operation and speed is controlled by commands sent over the Ethernet and power is not supplied by the Ethernet communication lines.

U.S. Publication Number 20190346163 was published on Nov. 14, 2019, to John Walsh and is titled Solid-state Electronic Apparatus to Provide Reliable Electric Power for Smart Communicating Thermostats. This publication discloses a solid-state adapter provides a common-wire functionality to an HVAC system including four wire connections between a thermostat and HVAC equipment. The adapter may include an embodiment of an efficient fan controller to provide a fan-off delay based on the duration of a heating cycle or the duration of a cooling cycle where the duration includes at least one duration selected from the group consisting of: a heating on time, a heating off time, a cooling on time, and a cooling off time. The common-wire function is required in many buildings with pre-existing low-voltage 4-wire electrical harnesses in order to provide continuous and reliable power to Smart Communicating Thermostats that connect to the internet using a wireless Ethernet network officially referred to as the IEEE 802.11 standard. Fan speed and operation is made by the Ethernet.

What is needed is a fan that is powered from Power over Ethernet (POE) and the operation of the fan is controlled locally to the fan. The proposed Power over Ethernet (PoE) cooling fan provides the solution.

BACKGROUND OF THE INVENTION

Ethernet switch comprises a plethora of ports that provide communications lines over a network to devices that receive and send user commands. Normally these lines just provide a conduit for communication to and/or from smart devices, more recently the Ethernet lines have been used to provide limited power to the communication devices to eliminate the need to provide additional power to the communication devices. The present PoE cooling fan is a cooling/exhaust fan module that has the ability to "steal" a portion of power from Ethernet data lines and may pass on data and power over Ethernet to another connected device.

SUMMARY OF THE INVENTION

It is an object of the power over Ethernet cooling fan for power that turns the fan to be provided by the Ethernet connection. The fan module is connected to the Ethernet such that power to the fan is from a portion of the power to the Ethernet that is stolen or otherwise parasitically harvested. Depending upon the available Ethernet power, the fan can be powered directly, or from a storage supply such as a battery. The speed of the fan can also be adjusted based on a local temperature sensor.

It is an object of the power over Ethernet cooling fan to be used for cooling, exhaust or air movement in, near, through or around devices or electrical components. In some cases, the fan is needed to focus cooling when needed at a particular device or heatsink while in other cases the fan is powered to draw air through a housing, enclosure or device.

It is another object of the power over Ethernet cooling fan to include a temperature sensor. Measuring a local temperature provides the best indicator when air movement and air volume is needed. The temperature sensor can be located on a specific device, housing or in the air around the fan. It is also contemplated that the temperature sensor can be located on a tether that can be "clipped" or joined onto a device to obtain a local temperature.

It is another object of the power over Ethernet cooling fan for fan speed and the temperature to be communicated to other devices or a host over the Ethernet. While the fan can operate autonomously when needed, the operation of the fan, along with temperature can be communicated over the Ethernet using a micro-controller or other device.

It is still another object of the power over Ethernet cooling fan to have cloud communication. The cloud communication allows for information regarding the fan speed and temperature to be retrieved or available from an application or database that provide real-time and/or historical information regarding fan and/or temperature.

Various objects, features, aspects, and advantages of the present invention will become more apparent from the following detailed description of preferred embodiments of the invention, along with the accompanying drawings in which like numerals represent like components.

DETAILED DESCRIPTION OF THE INVENTION

Figure 1:
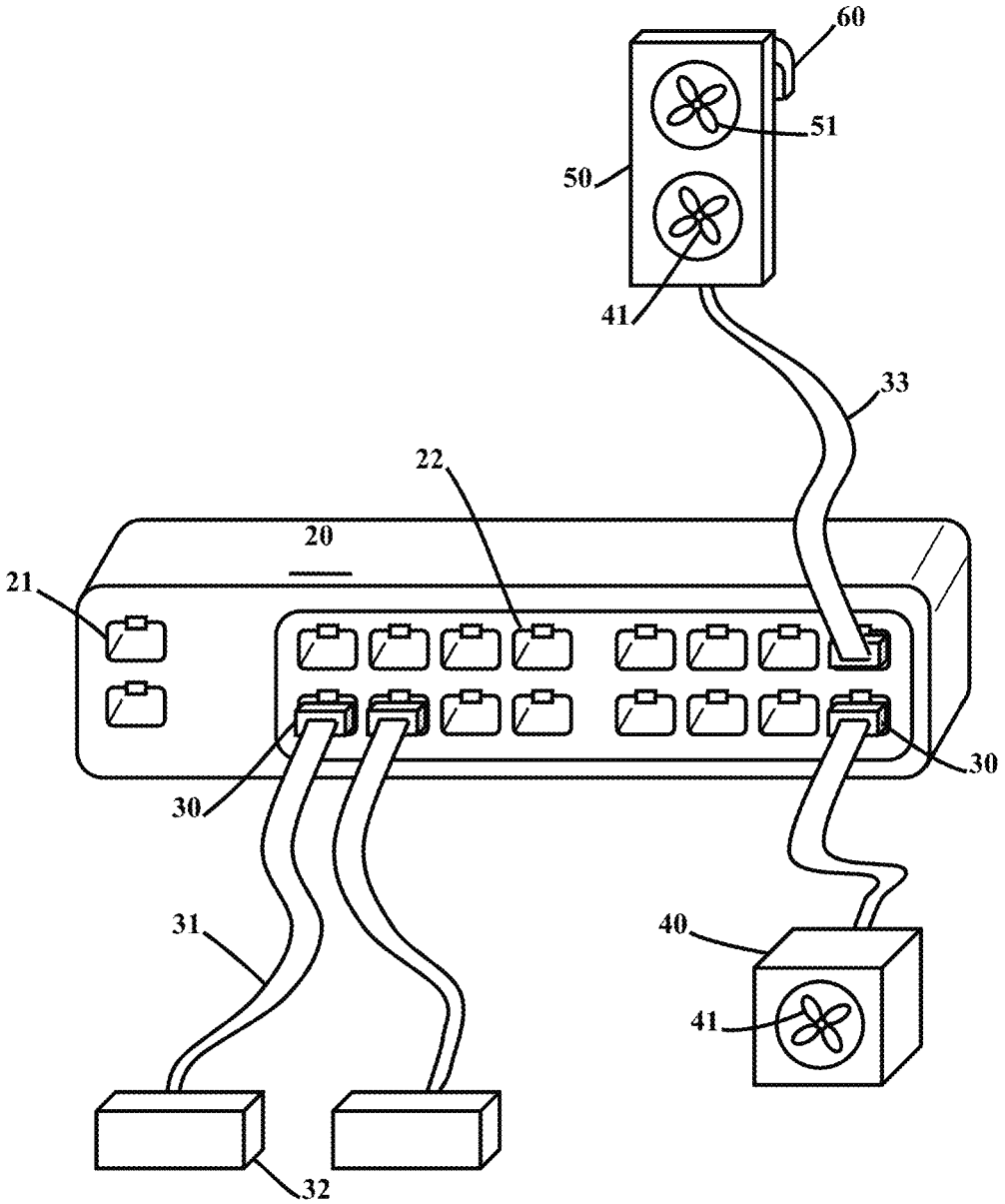
FIG. 1 shows a pictorial connection diagram of a Power over Ethernet (POE) cooling fan.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention but is merely representative of various embodiments of the invention. The illustrated embodiments of the invention will be best understood by reference to the drawings, wherein like parts are designated by like numerals throughout.

While this technology is susceptible of embodiment in many different forms, there is shown in the drawings and will herein be described in detail several specific embodiments with the understanding that the present disclosure is to be considered as an exemplification of the principles of the technology and is not intended to limit the technology to the embodiments illustrated. The terminology used herein is for the purpose of describing particular embodiments only and is not intended to be limiting of the technology. As used herein, the singular forms "a," "an," and "the" are intended to include the plural forms as well, unless the context clearly indicates otherwise.

It will be further understood that the terms "comprises," "comprising," "includes," and/or "including," when used in this specification, specify the presence of stated features, integers, steps, operations, elements, and/or components, but do not preclude the presence or addition of one or more other features, integers, steps, operations, elements, components, and/or groups thereof. It will be understood that like or analogous elements and/or components, referred to herein, may be identified throughout the drawings with like reference characters.

| Item Numbers and Description | |
|---|---|
| 20 Ethernet system | 21 Ethernet input port |
| 22 Ethernet output port | 30 RJ45 male connector |
| 31 cable | 32 terminal |
| 33 connection | 34 Ethernet connector |
| 40 fan housing | 41 fan |
| 42 PoE cooling fan | 50 fan housing |
| 51 fan | 52 temperature sensor |
| 53 controller | 54 driver |
| 55 battery | 56 pass through connector |
| 60 attachment mechanism | 70 machine powered ON |
| 71 initialize | 72 pairing |
| 73 communication | 74 check temperature |
| 75 turn fan ON | 76 check voltage |
| 7 change fan speed | 90 flow chart |

FIG. 1 shows a pictorial connection diagram of a Power over Ethernet (POE) cooling fan. In this figure, typical Ethernet system 20 is show with Ethernet input ports 21 and a plurality of Ethernet output ports 22. In this example there are 16 Ethernet output ports 22 for connection of devices but Ethernet systems can have more or less than 16 connections. The terminals 32 are shown with cables 31 connecting with RJ45 male connectors that are commonly used to connect into an Ethernet system 20, but the male/female connection does not limit the Power over Ethernet (POE) cooling fan(s) shown as fan housing 40 or fan housing 50 that can be installed where needed.

The Power over Ethernet (POE) cooling fan(s) shown as fan housing 40 or fan housing 50 have a RJ45 male connector 30 (or other connector) with a connection 33 or cable. This figure shows a fan housing 40 with a single fan 41. This figure also shows another embodiment fan housing 50 with fans 41 and 51 that can provide air flow in the same direction for cooling, exhaust or operating the fans in opposing flow directions for cooling and exhaust. Fan housing 50 shows an attachment mechanism 60 that can be a clip, magnet, hook-and-loop fastener, adhesive, adhesive strip(s) or screw bracket. A thermal sensor (not shown in this figure) can monitor a temperature on the Power over Ethernet (POE) cooling fan(s) shown as fan housing 40 or fan housing 50 or on a tether connection that is external of the housing. The temperature sensor is shown and described in other figures and description herein.

Figure 2:
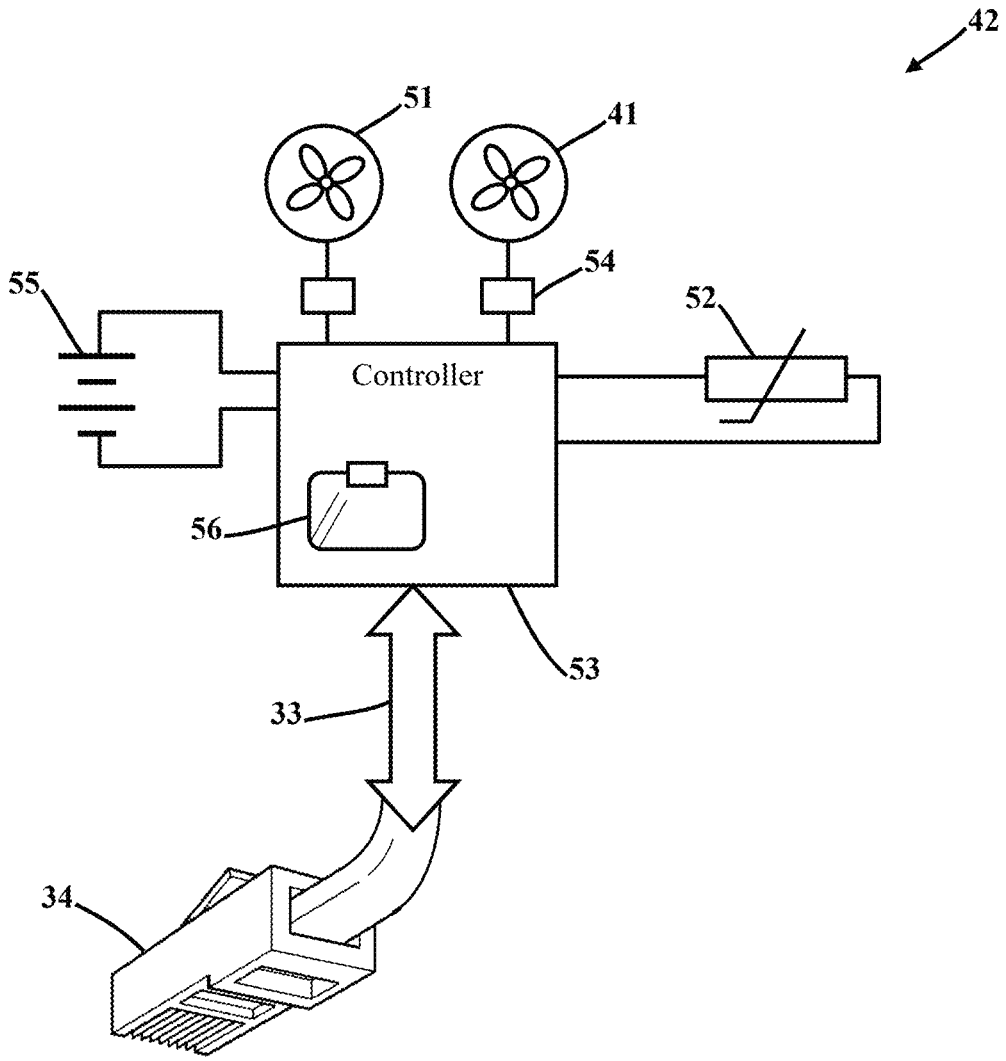
FIG. 2 shows a bock diagram of the PoE cooling fan.

FIG. 2 shows a bock diagram of the PoE cooling fan 42. The cable has a connection 33 to an Ethernet connector 34 that provides communication over the Ethernet connection. The PoE cooling fan 42 "steals" or extracts power from the Ethernet connection 33 as a parasitic device. Within the PoE cooling fan 42 is a controller 53. The controller 33 is shown with at least one fan 41/51. The fans 41 and 51 can provide air flow in the same direction for cooling, exhaust or operating the fans in opposing flow directions for simultaneous cooling and exhaust. The fan(s) 41 and or 51 can be connected to the controller 53 through a driver 54 such as a transistor, DIAC, SCR, relay or other device that can supply power or control to the fan(s) 41/51. The fan(s) 41/51 can be powered in an On/Off condition or can be speed controlled using a variable voltage or pulse width modulation (PWM).

The controller 53 is shown connected to a temperature sensor 52. The temperature sensor 52 can be a simple thermistor or an intelligent temperature sensor and is used to determine a local temperature sensor 52. The temperature sensor can be installed on the circuit board that contains the controller 53 or could be connected with a tether so the temperature sensor can be connected or attached to a surface such as a heat sink.

In some situations, the power to drive the fan(s) 41/51 may exceed the available power from the Ethernet. There are a number of situations where the cooling fan(s) 41/51 may run intermittently and demand more power than the Ethernet can provide such as a cooling fan for a product that runs very intermittently. In these situations, the controller 53 can charge or trickle charge a battery 55 so a power demand beyond the power available from the Ethernet can be provided by the battery 55.

The controller 53 is shown with an Ethernet pass through 56 whereby a user can unplug an Ethernet device, connect the PoE cooling fan 42 and then plug the Ethernet device into the Ethernet pass through 56.

Figure 3:
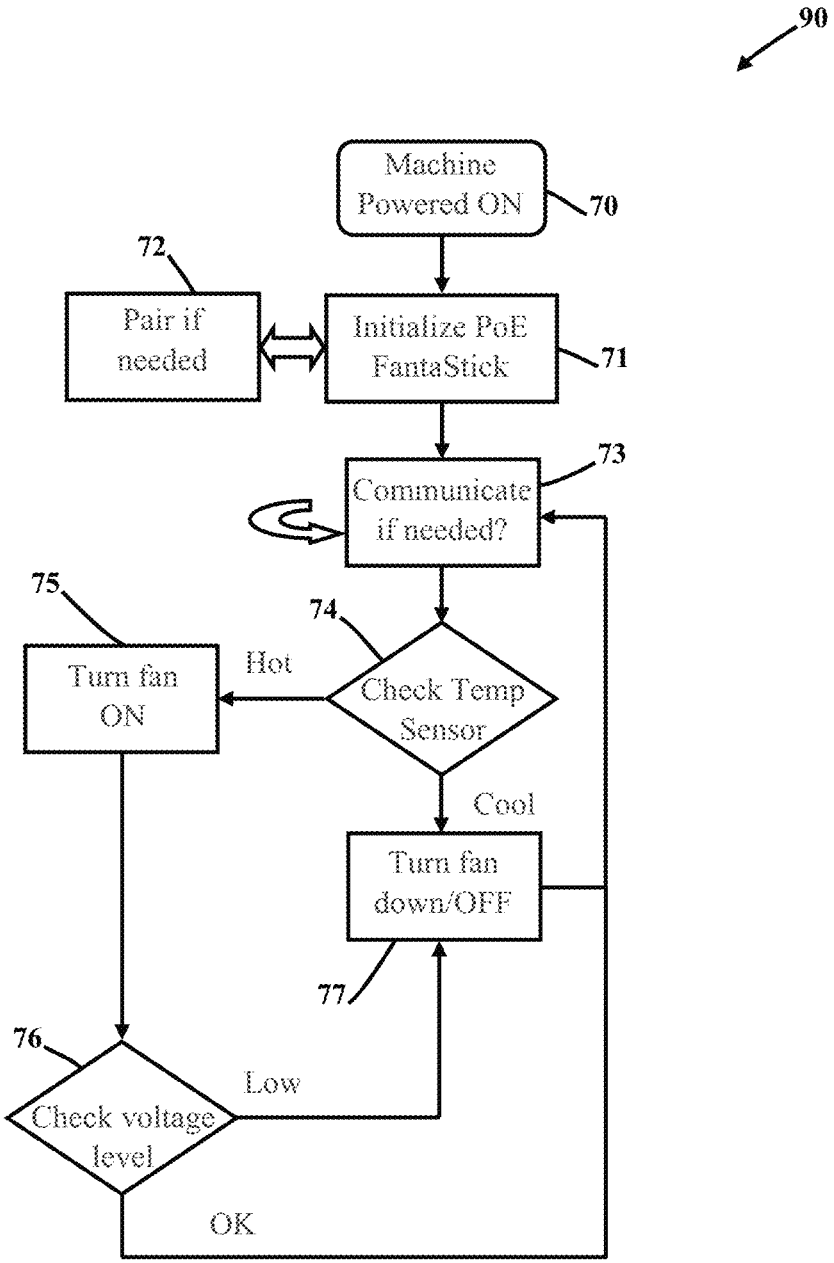
FIG. 3 shows a logic flow chart for the PoE cooling fan.

FIG. 3 shows a logic flow chart 90 for the PoE cooling fan. When an Ethernet device is powered, the communication lines to the PoE cooling fan 42 are powered and the machine is powered On 70. The PoE cooling fan 42 will then initialize the Power over Ethernet (POE) device or Fanta-Stick 71. The PoE cooling fan 42 can pair if needed 72 to the Ethernet master. The PoE cooling fan 42 can remain in communication if needed 73 and can remain in communication while the PoE cooling fan 42 is connected. It is also contemplated that the communication can be over a cloud service to provide internal temperature or connection to a cloud service for monitoring, usage, health, and control of the fan, and any device the housing or temperature sensor is connected.

The temperature sensor is checked 74 and if the temperature sensor detects a temperature that is hot, the fan will be turned on 75. If the temperature is below a threshold the fan can be turned off or down 77. When the fan is in operation the system voltage can be monitored or checked 76 to ensure that the power consumption of the fan does not compromise the available power from the Ethernet communication lines. Turing the fan down can elongate the time for using the fan at a higher fan speed or to reduce the power consumption to a below a limit that will drop the voltage 76. It is also contemplated that the fan can be activated based upon communication 73 with a host or master through the Ethernet.

Use or information regarding the fan, temperature or voltage level can be communicated to the Ethernet or through the pass-through connector 56 shown and described previously herein.

Thus, specific embodiments of a PoE cooling fan have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A power over Ethernet fan comprising:

a connection to an Ethernet;

said connection to said Ethernet providing power to a controller;

a temperature sensor connected to said controller;

a battery or a capacitor power storage device;

said controller monitors a power level in said power storage device;

said controller is configured to extract at least some power from an Ethernet communication line and store at least some of said extracted power to charge said power storage device to intermittently operate a fan based upon a temperature from said temperature sensor, and said controller further monitors a voltage from said Ethernet to determine if there is a reduction of power based upon use of said fan and power said fan with a combination of power from said Ethernet and said power storage device when a power demand for said fan exceeds the power available from said Ethernet.

2. The power over Ethernet fan according to claim 1, wherein said controller is within a housing and said housing has at least one of a clip, a magnet, a hook-and-loop fastener, an adhesive, an adhesive strip(s) or a screw bracket.

3. The power over Ethernet fan according to claim 1, further includes a connection to a cloud server.

4. The power over Ethernet fan according to claim 3, wherein said connection provides information from said controller to at least one of a group consisting of a temperature, a health of said controller or a fan speed.

5. The power over Ethernet fan according to claim 1, wherein a speed of said fan is variable.

6. The power over Ethernet fan according to claim 1, wherein said variable fan speed is controlled using a variable voltage or a pulse width modulation.

7. The power over Ethernet fan according to claim 5, wherein said speed of said fan is adjusted based upon said temperature sensor.

8. The power over Ethernet fan according to claim 1, further includes at least a second fan.

9. The power over Ethernet fan according to claim 8, wherein a direction of air flow from said fan and said at least a second fan is controllable.

10. The power over Ethernet fan according to claim 1, wherein said controller pairs to an Ethernet master.

11. The power over Ethernet fan according to claim 10, wherein said pairing is through a cloud server.

* * * * *